US005343807A

United States Patent [19]

Hackelborger et al.

[11] Patent Number: 5,343,807

[45] Date of Patent: Sep. 6, 1994

[54] SHEET-GUIDING IMPRESSION-CYLINDER CASING PROFILE

[75] Inventors: Gerhard Hackelborger; Werner Sondergeld, both of Offenbach am Main, Fed. Rep. of Germany

[73] Assignee: Man Roland Druckmaschinen AG, Fed. Rep. of Germany

[21] Appl. No.: 27,684

[22] Filed: Mar. 8, 1993

[30] Foreign Application Priority Data

Mar. 6, 1992 [DE] Fed. Rep. of Germany ..... 4207119

[51] Int. Cl.[5] ..... B41F 1/28

[52] U.S. Cl. ..... 101/415.1; 101/420; 492/30

[58] Field of Search ..... 101/420, 422, 415.1; 492/22, 25, 30

[56] References Cited

U.S. PATENT DOCUMENTS

| | | | |
|---|---|---|---|
| 3,599,306 | 8/1971 | Brafford | 492/30 |
| 4,327,135 | 4/1982 | Wirz et al. | 428/600 |
| 4,688,784 | 8/1987 | Wirz | 271/195 |
| 5,042,383 | 8/1991 | Wirz | 101/420 |

FOREIGN PATENT DOCUMENTS

| | | | |
|---|---|---|---|
| 1000832 | 1/1957 | Fed. Rep. of Germany | 101/420 |
| 1100651 | 3/1961 | Fed. Rep. of Germany . | |
| 2446188A1 | 4/1976 | Fed. Rep. of Germany . | |
| 2605330A1 | 8/1976 | Fed. Rep. of Germany . | |
| 2820549A1 | 1/1979 | Fed. Rep. of Germany . | |
| 2916505A1 | 10/1980 | Fed. Rep. of Germany . | |
| 3422443A1 | 12/1985 | Fed. Rep. of Germany . | |
| 3913818A1 | 10/1990 | Fed. Rep. of Germany . | |
| 3931479A1 | 4/1991 | Fed. Rep. of Germany . | |
| 59-30485 | 7/1984 | Japan | 492/30 |
| 61-162453 | 7/1986 | Japan | 492/30 |
| 2-56351 | 2/1990 | Japan | 492/30 |

*Primary Examiner*—Eugene H. Eickholt
*Attorney, Agent, or Firm*—Leydig, Voit & Mayer, Ltd.

[57] ABSTRACT

An improved surface casing for a sheet-guiding printing cylinder comprising a number of elevations having constant cross-sectional areas extending radially therefrom to form a sheet bearing surface. The constant cross-sectional area over the length of the elevations ensures that as the elevations are worn down over time, the overall bearing area does not increase. As a result, smearing of the printing image, which is related to the total bearing area, does not increase over time. Additionally, the total bearing area does not increase for sheets having a low paper weight due to sagging of the sheet between the elevations.

12 Claims, 3 Drawing Sheets

SHEET-GUIDING IMPRESSION-CYLINDER CASING PROFILE

FIELD OF THE INVENTION

This invention relates generally to sheet-guiding cylinders in printing machines, and more particularly to a casing profile for an impression or sheet transfer cylinder of a printing machine.

BACKGROUND OF THE INVENTION

When sheets are transported through a printing machine, their printed side often bears against printing cylinders and/or drums. This tends to cause a smearing of the printed image if there is even the slightest relative motion between the sheet and the outer cylindrical surface. When both sides of a sheet are printed, it is even more difficult not to smear the image since an inked side will always bear against one of the cylinders, and any ink that has not fully dried will come into contact with the bearing surface. However, it is known that by reducing the total surface area where the sheet contacts the cylinder, smearing of sheets can be reduced. Accordingly, various attempts to reduce the total bearing area have been made to remedy the smearing problem.

For example, German Utility Model 18 31 636 attempts to solve the smearing problem by roughening the casing surfaces surrounding the cylinders with a knurling tool. The printed sheets thus are supported at the different height elevations of the casing surface. However, the sheet bears unevenly due to the different elevations, and ink tends to build up in the casing surface. Thus the smearing is ultimately increased, especially as the roughened casing surface becomes worn down over time.

Alternatively, German Patent no. DE 1,100,651 discloses an attempt to solve the smearing problem by providing a casing consisting of a firm fabric base and a special rubber layer into which a number of small glass beads are imbedded. The sheet then does not contact the cylinder directly, but instead bears on the beads.

U.S. Pat. Nos. 5,042,383, 4,327,135 and 4,688,784 (corresponding to German Patent nos. DE 2,446,188, DE 2,916,505 and DE 3,422,443 respectively) as well as German Patent No. DE 3,931,479 are directed to cylinders having hemispherical domes of equal height distributed over the casing surfaces or foil covers. The domes are chemically coated and are arranged to enable both airflow and ink runoff to prevent ink from building up (i.e., mantling) on the domed bearing surfaces.

However, although the mantling of ink is reduced with these aforementioned dome-shaped casings, when printing materials having a low paper weight are used, the sheets sag atop the domes, thus increasing the overall amount of sheet-to-dome bearing area (i.e., the total surface contact area). Smearing thus increases with lower-weight sheets. Moreover, wear and abrasion cause the upper contact areas of the domes to flatten out over time. Thus, over time, sheets bear against an exponentially increasing contact area, which results in a corresponding progressive increase in ink smearing.

Finally, German Patent DE 3,913,818 (assigned to the assignee of the present application), discloses an impression cylinder having a reticular screen structure of a predetermined screen fineness. Although ink mantling is reduced using this screened casing surface, the irregular lines of the screen comprise the raised bearing surface for the sheet. Since the screen is relatively fine, these lines provide a large total bearing surface, which again results in ink smearing. This is especially prevalent in two-sided printing operations.

SUMMARY OF THE INVENTION

Accordingly, it is an object of the present invention to provide an improved casing profile for a printing cylinder that reduces smearing and mantling.

Another object is to provide an improved casing profile for a printing cylinder having a statistically uniform distribution of cylindrical elevations such that the casing surface maintains essentially the same overall sheet-bearing area over time.

A further object is to provide a casing profile for a printing cylinder that maintains all of the bearing points at an essentially constant height.

Yet another object is to provide a casing profile for a printing cylinder that reduces smearing regardless of whether sheets are printed on one or two sides.

Still another object is to provide a casing profile for a printing cylinder that supplies an essentially constant overall surface bearing area regardless of the weight of the sheet material utilized.

Other objects and advantages will become apparent from the following detailed description when taken in conjunction with drawings, in which:

Figure 1:
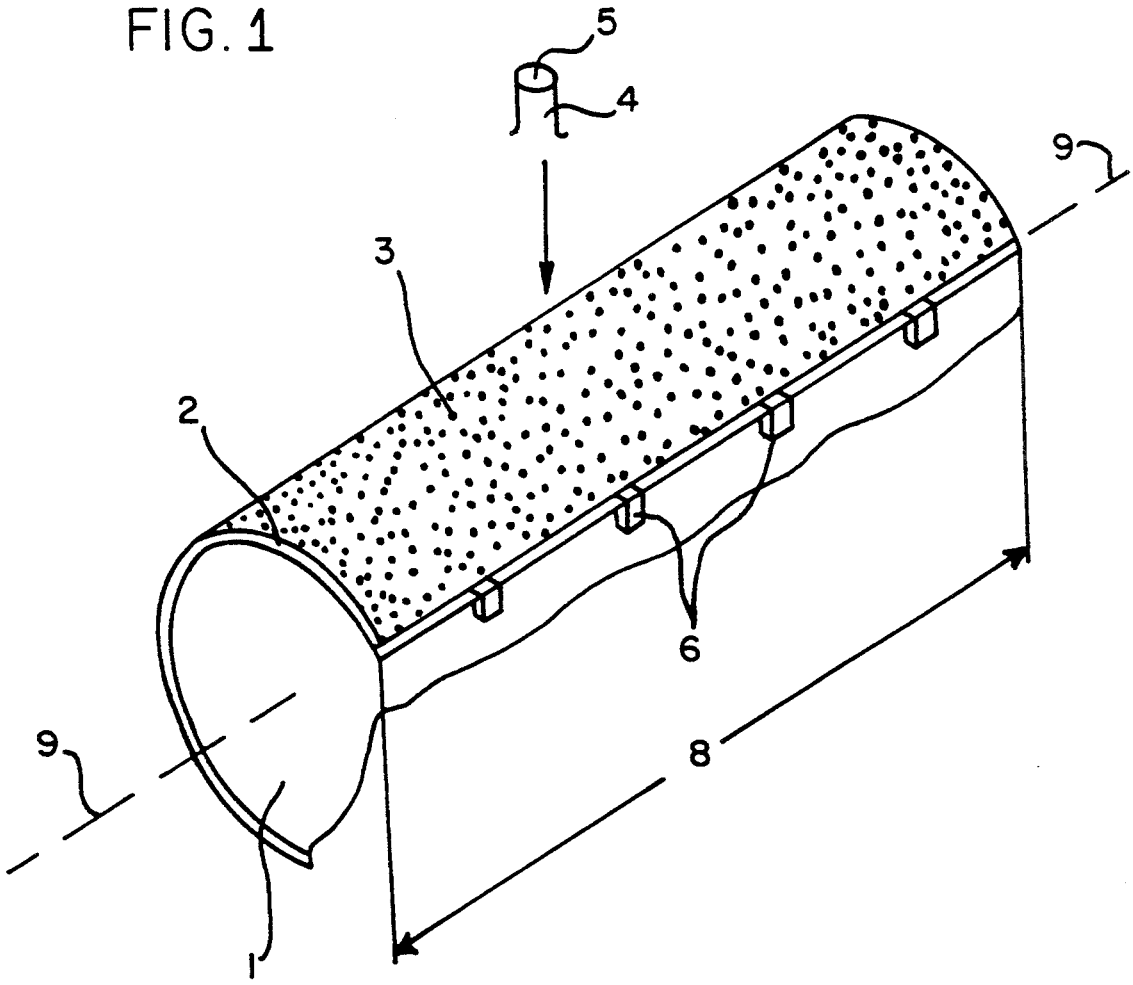
FIG. 1 is a partially diagrammatic depiction of an impression cylinder having a casing surface according to the invention with one of the cylindrical elevational elements thereof shown in enlarged expanded fashion.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Turning now to FIG. 1 of the drawings, there is shown an illustrative impression cylinder 1 embodying the present invention, such as incorporated in a typical sheet-fed printing machine. The impression cylinder 1 has an outer surface casing 2, for example, which may be a chromium layer. To facilitate engagement of sheets for transfer about the cylinder, the cylinder has a plurality of gripper supports 6 of a conventional type.

In accordance with the invention, the outer surface of the cylinder has formed therein a plurality of substantially equal length elevations which each have a substantially constant cross-sectional area along their length for defining a sheet bearing surface adapted for prolonged usage. To this end, in the illustrated embodiment, the surface casing 2 has etched or otherwise formed therein a plurality of individual cylindrical, radially-extending elevations 4 which are of substantially equal height and which each have a substantially uniform cross-sectional area along the length of the elevation. The elevations 4 each terminate in a flat sheet contact surface 5, which together define a cylindrical profile 3 about which a sheet is positionable. To provide for evenly distributed sheet bearing and to counteract a phenomenon known as Moire formation in the print, the cylindrical elevations 4 are preferably distributed over the entire surface of the coating 2 in a statistically uniform pattern, that is, approximately the same number of elevations 4 are present per unit area.

To form the elevations, the hard chromium layer or surface casing 2 of the cylinder may be etched in a conventional manner. As is known in the art, the areas of the elevations 4 can be selectively covered to resist etching of the surface casing 2 at such locations. Alternatively, other processes, such as engraving or coating, can be utilized to produce the elevations 4. Additionally, the casing profile can be formed directly on the printing cylinder 1 or can be made on a plate, foil or the like which can be attached to the cylinder 1.

Figure 2:
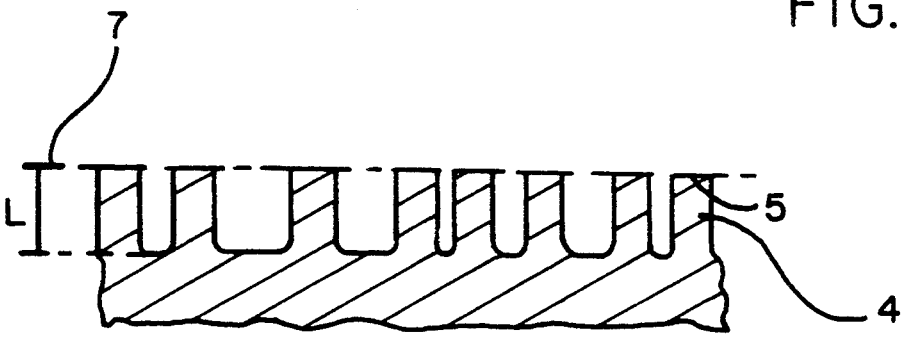
FIG. 2 is an enlarged fragmentary cross-sectional view of the casing surface showing the cylindrical elevations thereof.

Although the base of the elevations 4 may be slightly greater in cross-sectional area than the remainder of the elevation due to the formation process, for best results each cylindrical elevation 4 extends for a discrete length L above its base at an essentially constant diameter, that is, it does not appreciably narrow or widen over its length L (see FIG. 2).

As best shown in FIG. 2, the length L of each cylindrical elevation 4 is essentially equal. Taken as a whole, the contact surfaces 5 of the cylindrical elevations 4 form a cylinder sheet bearing plane or surface 7. Since the contact surfaces 5 are essentially flat and since each cylindrical elevation 4 is perpendicular to the surface 2, each contact surface 5 that makes up the bearing surface 7 is plane-parallel to the cylinder axis 9.

Preferably, the length L of each cylindrical elevation 4, (which can alternatively be regarded as an etching depth), is approximately 80 microns, although lengths from 20 microns to 200 microns are practical. Regardless of the dimensions actually used, the preferred minimum distance between two adjacent cylindrical elevations 4 is approximately 25 percent of the diameter of the elevations 4. The percentage of the average area that actually bears on the bearing surface 7 varies from ten to forty percent, depending on the actual dimensions chosen.

Figure 3:
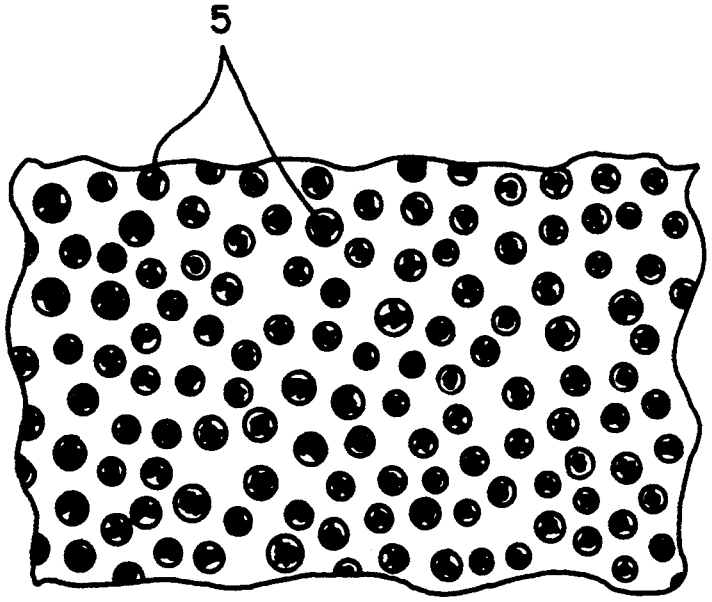
FIG. 3 is a top plan view of the casing surface shown in FIG. 2.
Figure 4:
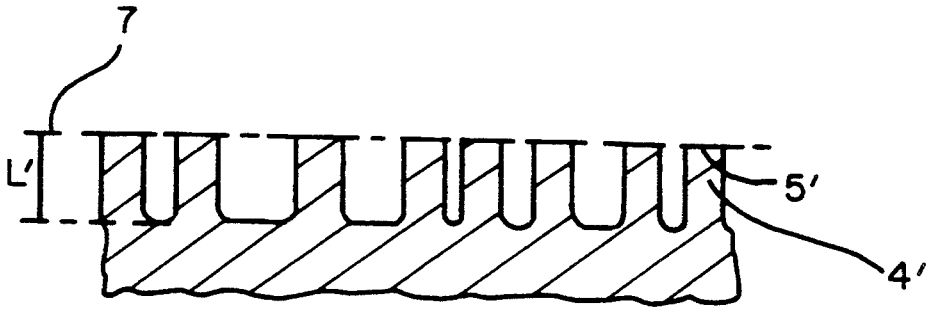
FIG. 4 is an enlarged fragmentary cross-sectional view of a casing surface similar to FIG. 2 but having elevations of elliptical cross section.
Figure 5:
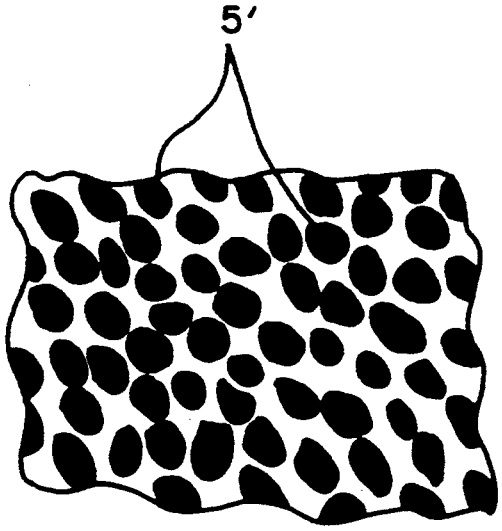
FIG. 5 is a top plan view of the casing surface shown in FIG. 4.

As best shown in FIG. 3, the contact surfaces 5 of each cylindrical elevation 4 are essentially circular, although as shown in FIGS. 4 and 5, elliptical surfaces 5' with correspondingly shaped elevations 4' can also be used. The elliptical elevations 4' each have substantially uniform cross-sectional area along their entire length L' from their bases.

Regardless of whether the elevations are cylindrical, elliptical, or other shape, the contact surfaces 5 preferably have equal diameters (or equal major and minor axes), although diameters formed within tolerances of plus or minus twenty percent do not adversely affect the quality of the printed image.

Preferably, the cylindrical elevations 4 are distributed so that the density of their contact surfaces 5 correspond to a screen fineness of approximately 60 lines per centimeter, although the fineness distribution can range from 20 lines/cm to 100 limes/cm.

Accordingly, during use of the cylinder, a sheet contacts the bearing surface 7 (formed by the plurality of contact surfaces 5) only to a minimal extent. Because the contact surfaces 5 are essentially flat, and because the elevations 4 do not increase in diameter nearer the surface, even sheets having a low paper weight do not increase the bearing area as they sag. Most significantly, as the elevations 4 are worn down over time, the total percentage of the sheet in contact with the contact surfaces 5 does not increase, because the diameters and hence the contact surfaces 5 (or 5') of the cylindrical elevations 4 (or elliptical elevations 4') are essentially the same in area regardless of how much the length L decreases due to wear over time.

As can be seen from the foregoing, an improved casing profile for a printing cylinder that reduces smearing and mantling is provided. Regardless of the amount of wear or the grade of paper, the shape of the elevations ensure that the casing surface maintains an essentially constant overall sheet-bearing area. Accordingly, the described casing profile reduces smearing of the printed image and mantling, and does so regardless of whether sheets are printed on one or two sides.

What is claimed is:

1. A rotatable printing cylinder in a sheet-fed printing machine about which printed sheets are directed without substantial relative movement between the printing cylinder and the sheet comprising a cylindrical drum, means defining a surface surrounding the cylindrical drum, said surface defining a plurality of substantial equal length elevational elements extending radially from a base surface, said elevational elements having flat outermost surfaces which define a cylindrical sheet bearing surface having an area substantially less than the total area of the printing cylinder and upon which sheets may be supported during direction about the printing cylinder, and said elevational elements each individually having a substantially constant cross-sectional area along substantially the length thereof such that upon wear of said elevational elements the total area of the sheet bearing surface remains substantially unaffected and the sheets can be continuously directed about the cylinder without substantial relative movement between the sheets and printing cylinder and without smearing of printing on the sheets.

2. The printing cylinder of claim 1 in which said elevational elements are cylindrical having circular cross-sections.

3. The printing cylinder of claim 1 in which said elevational elements have elliptical cross sections.

4. The printing cylinder of claim 1 wherein the elevations are distributed in a statistically uniform distribution over the surface.

5. The printing cylinder of claim 1 wherein the radial length of the elevations is approximately 80 microns.

6. The printing cylinder of claim 1 wherein the radial length of the elevations is between 20 microns and 200 microns.

7. The printing cylinder of claim 1 wherein the percentage of the area of the sheet bearing surface relative to the total area of the printing cylinder surface is between ten and forty percent.

8. The printing cylinder of claim 1 wherein said surface defining means surrounding the cylinder is permanently attached to the cylinder.

9. The printing cylinder of claim 1 wherein said surface defining means surrounding the cylinder is selectively attachable to the cylinder.

10. A printing cylinder comprising a cylindrical drum, means defining a surface surrounding the cylindrical drum, said surface defining a plurality of substantially equal length elevational elements extending radially from a base surface, said elevational elements each individually having a substantially constant cross-sectional area along substantially the length thereof, said elevational elements defining a screen having a fineness of between 20 lines per centimeter and 200 lines per centimeter, said elevational elements each having a flat outermost surface, and the outermost surfaces of said elevational elements defining a cylindrical sheet bearing surface.

11. A printing cylinder comprising a cylindrical drum, means defining a surface surrounding the cylindrical drum, said surface defining a plurality of substantially equal length elevational elements extending radially from a base surface, said elevational elements each individually having a substantially constant cross-sectional area along substantially the length thereof, adjacent elevational elements being separated by a distance of approximately 25 percent of the diameter of the average circular cross-sectional area of the individual elevational elements, said elevational elements each having a flat outermost surface, and the outermost surfaces of said elevational elements defining a cylindrical sheet bearing surface.

12. The printing cylinder of claim 11 wherein the elevations define a screen having a fineness of about 60 lines per centimeter.

* * * * *